United States Patent [19]

Ogasawara

[11] Patent Number: 4,794,340

[45] Date of Patent: Dec. 27, 1988

[54] SYNCHROTRON-TYPE ACCELERATOR WITH ROD-SHAPED DAMPING ANTENNA

[75] Inventor: Munehiro Ogasawara, Kawasaki, Japan

[73] Assignee: Kabushiki Kaisha Toshiba, Kawasaki, Japan

[21] Appl. No.: 127,089

[22] Filed: Dec. 1, 1987

[30] Foreign Application Priority Data

Dec. 2, 1986 [JP] Japan ..... 61-287129

[51] Int. Cl.[4] ..... H05H 13/04

[52] U.S. Cl. ..... 328/235; 315/5.54; 333/228

[58] Field of Search ..... 315/5.42, 5.22, 5.54; 328/235; 333/228

[56] References Cited

U.S. PATENT DOCUMENTS 2,605,459 7/1952 Cook ..... 333/228

3,227,917 1/1966 Nishida ..... 333/232 X

FOREIGN PATENT DOCUMENTS 857342 12/1960 United Kingdom ..... 315/5.54

OTHER PUBLICATIONS

IEEE Transactions on Nuclear Science, vol. NS-28, No. 3 (Jun. 1981) R. Sundelin et al., "CESR RF System".

IEEE Transactions on Nuclear Science, vol. NS-28, No. 3, Jun. 1981, Y. Yamazaki et al., "Damping Test of the Higher-Order Modes of the Re-Entrant Accelerating Cavity".

"Design of a Synchrotron Radiation Facility for Orsay's ACO Storage Ring: Lure," by P. M. Guyon, *Rev. Sci. Instrum.*, vol. 47, No. 11, Nov. 1976, pp. 1347-1356.

*Primary Examiner*—Palmer C. DeMeo

*Attorney, Agent, or Firm*—Oblon, Fisher, Spivak, McClelland, & Maier

[57] ABSTRACT

A synchrotron-type accelerator of the invention has a torus-shaped beam duct and an acceleration section inserted in the beam duct. The acceleraton section has an accelerating cavity communicating with the interior of the beam duct. An RF electric field is applied to the interior of the accelerating cavity. A damping antenna such as a loop antenna is arranged in the accelerating cavity. The damping antenna is supported to be movable in a direction with proper angle to the axis of the accelerating cavity and is connected to a linear drive unit arranged outside the acceleration section. The linear drive unit moves the damping antenna in a direction with proper angle to the axis of the accelerating cavity, so that an insertion amount of the damping antenna with respect to the accelerating cavity is varied.

5 Claims, 3 Drawing Sheets

SYNCHROTRON-TYPE ACCELERATOR WITH ROD-SHAPED DAMPING ANTENNA

BACKGROUND OF THE INVENTION

The present invention relates to a synchrotron-type accelerator and, more particularly, to a synchrotron-type accelerator which can stably accelerate a large current, i.e., a large number of charged particles of both low- and high-energy states.

FIELD OF THE INVENTION

As is conventionally known, in the manufacture of semiconductor integrated circuits, an exposure technique is essential in order to form a predetermined pattern on a substrate of a semiconductor integrated circuit. However, with the conventional exposure technique using ultraviolet rays, it is impossible due to its principle to increase the integration or elements per chip of the semiconductor integrated circuit. Therefore, in the recent exposure technique, X-rays having a shorter wavelength than that of the ultraviolet rays are used to increase the integration of the semiconductor integrated circuit.

The exposure technique using X-rays requires an X-ray generator. Various types of X-ray generators are conventionally proposed. For example, X-ray lithography using a synchrotron-type accelerator (to be merely referred to as a synchrotron hereinafter) as the X-ray generator is proposed.

The principle of generating X-rays with the above X-ray lithography will be briefly described. X-rays, i.e., soft X-rays are derived from synchrotron orbital radiation (SOR) generated by the synchrotron. The soft X-rays can be highly collimated and are suitable for use in the exposure step in the manufacture of semiconductor integrated circuits.

The structure of the synchrotron will be briefly described. The synchrotron has a beam duct defining the circular orbit of the charged particles, and an accelerating cavity, to be merely referred to as a cavity hereinafter, inserted in the beam duct and applied with an RF electric field, i.e., an acceleration electric field. The charged particles are accelerated by the acceleration electric field when they pass through the cavity.

However, not only a component of the target fundamental mode, i.e., the so-called TM (transverse magnetic) 010 mode but also components of parasitic modes can be also excited in the cavity when the charged particles pass the cavity. These parasitic modes may let the flow of the charged particles to be unstable.

It is proposed to arrange a damping antenna in the acceleration cavity in order to damp the parasitic mode components described above. However, when the damping antenna is fixed in position, it is difficult to efficiently accelerate charged particles that constitute a large current and reside in the range of from the low- to high-energy state.

More specifically, in order to accelerate charged particles of a large current and of low energy, the parasitic mode components must be largely attenuated by the damping antenna. However, when charged particles of high energy are accelerated, the growth rate of the parasitic mode components are small compared to the radiation damping rate of electron eigen oscillation, i.e., betatron oscillation or synchrotron oscillation. Therefore, the parasitic mode components need not be so attenuated by the damping antenna as low energy case.

Rather, it is desired that detriment of the fundamental-mode component by the damping antenna must be prevented.

Assume that the coupling of the damping antenna and the parasitic mode components is set such that the parasitic mode components generated upon acceleration of low-energy electrons are efficiently attenuated by the damping antenna. In this case, when high-energy electrons are to be accelerated, the fundamental-mode component is largely attenuated by the damping antenna. In contrast to this, assume that the coupling of the fundamental-mode component and the damping antenna is set such that the fundamental-mode component is not attenuated by the damping antenna upon acceleration of high-energy electrons. In this case, when low-energy electrons are to be accelerated, it is difficult to effectively attenuate the parasitic mode components by the damping antenna, because the coupling of the parasitic mode components and the damping antenna is too small.

SUMMARY OF THE INVENTION

It is, therefore, an object of the present invention to provide a synchrotron-type accelerator which can stably accelerate charged particles that constitute a large current and reside in the range from the low- to high-energy state.

The above object is achieved by the synchrotron-type accelerator according to the present invention. The accelerator comprises:

orbital means comprising a beam duct defining an orbit of charged particles, that constitutes a closed loop;

an accelerating section inserted in the beam duct and defining an accelerating cavity therein, the accelerating cavity having a predetermined path area in a plane perpendicular to the orbit of the charged particles;

applying means for applying an RF electric field in the accelerating cavity, the RF electric field accelerating the charged particles passing the accelerating cavity;

a damping antenna, arranged in the accelerating cavity, for damping an undesired parasitic mode component in the accelerating cavity; and adjusting means for manipulating the damping antenna from outside the accelerating section and for adjusting a position of the damping antenna in the accelerating cavity and/or an area occupied by the damping antenna with respect to the path area of the accelerating cavity.

According to the synchrotron-type accelerator of the present invention, with the above-described adjusting means, the position of the damping antenna in the accelerating cavity and/or the area occupied by the damping antenna with respect to the path area in the accelerating cavity can be adjusted. Therefore, the coupling of the undesired parasitic mode components excited in the accelerating cavity and the damping antenna can be selectively varied, in other words, an undesired parasitic mode components can be effectively attenuated. As a result, charged particles by residing in the range from a low- to high-energy state can be stably accelerated by the fundamental mode.

DETAILED DESCRIPTION OF THE PREFERRED EMBODIMENTS

Figure 1:
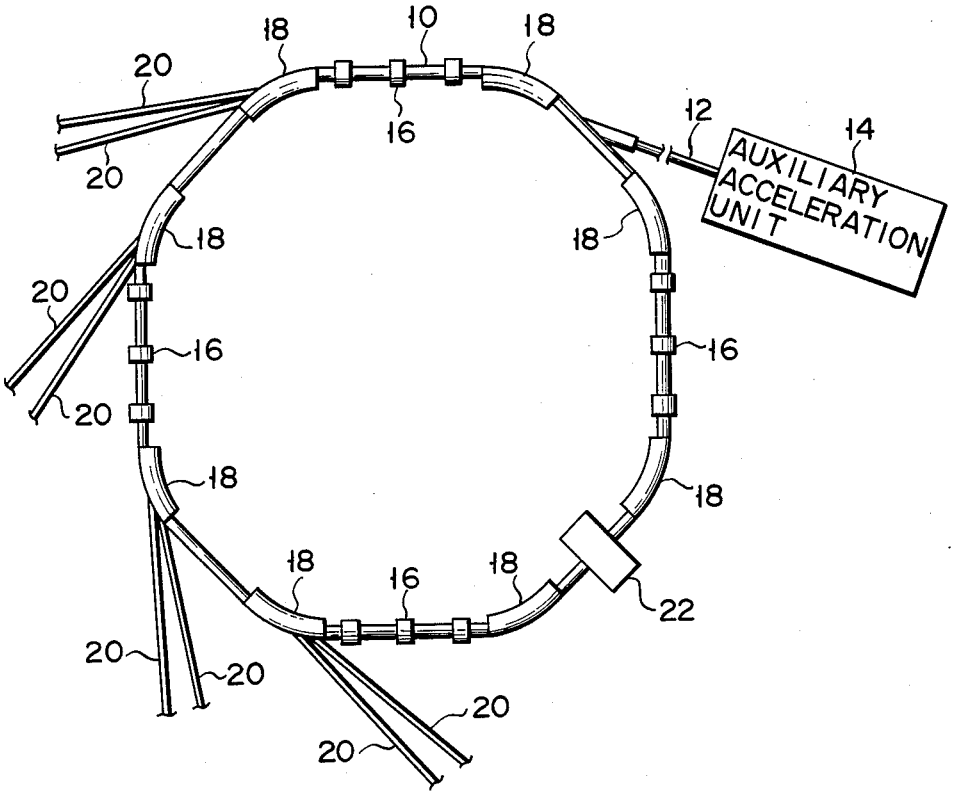
FIG. 1 is a schematic view of a synchrotron-type accelerator according to an embodiment of the present invention which is applied to X-ray lithography.

A synchrotron-type accelerator shown in FIG. 1 has beam duct 10 having a torus shape, e.g., a polygonal shape such as an octagon. Duct 10 defines an orbit of charged particles, i.e., electrons. Tube 10 is connected to a vacuum pump (not shown) as a negative pressure source, and the interior of tube 10 is evacuated to a predetermined vacuum pressure by the vacuum pump.

Duct 10 is connected to auxiliary acceleration unit 14 through connection tube 12. Acceleration unit 14 accelerates charged particles, i.e., electrons to a predetermined speed. A plurality of magnetic units 16 are arranged to surround duct 10. Magnetic units 16 focus the electron beams in duct 10.

Deflection units 18 for applying a deflecting magnetic field to beam tube 10 are arranged at portions of duct 10 corresponding to the vertexes of the octagon. The orbit of the beam in duct 10 is bent by the deflecting magnetic field applied by deflection units 18. Thus, the electron beam in duct 10 defines a circular orbit constituting a closed loop.

Guide tubes 20 extend from several portions of acceleration tube 10 which are provided with deflection units 18 described above. Guide tubes 20 guide synchrotron orbit radiation (SOR), generated when the electrom beam in tube 10 passes through deflection units 18, to a next unit (not shown) so that soft X-rays included in SOR are utilized in the manufacture of the semiconductor integrated circuits, i.e., in the exposure process.

Acceleration section 22 is arranged at one of the straight portions of beam duct 10. Acceleration section 22 has hollow cylindrical housing 24 as shown in detail in FIG. 2. Flanges 26 are formed at two ends of housing 24 and are airtightly connected to corresponding flanges of duct 10.

Accelerating cavity 28 having a predetermined shape is defined in housing 24. Cavity 28 communicates with acceleration tube 10 and defines part of the electron circular orbit described above.

Two holes 30 and 32 are formed in housing 24 so that their axes are perpendicular to that of acceleration tube 10. The axes of holes 30 and 32 are appropriately aligned.

One hole, e.g., coupling hole 30 in an upper portion of housing 24 is airtightly connected to RF oscillator 34 through flange coupling. Oscillator 34 has coupling antenna 36 located in coupling hole 30 and can apply an RF electric field to acceleration cavity 28 by antenna 36. Therefore, when electrons pass through cavity 28, they are accelerated by the RF electric field.

Figure 2:
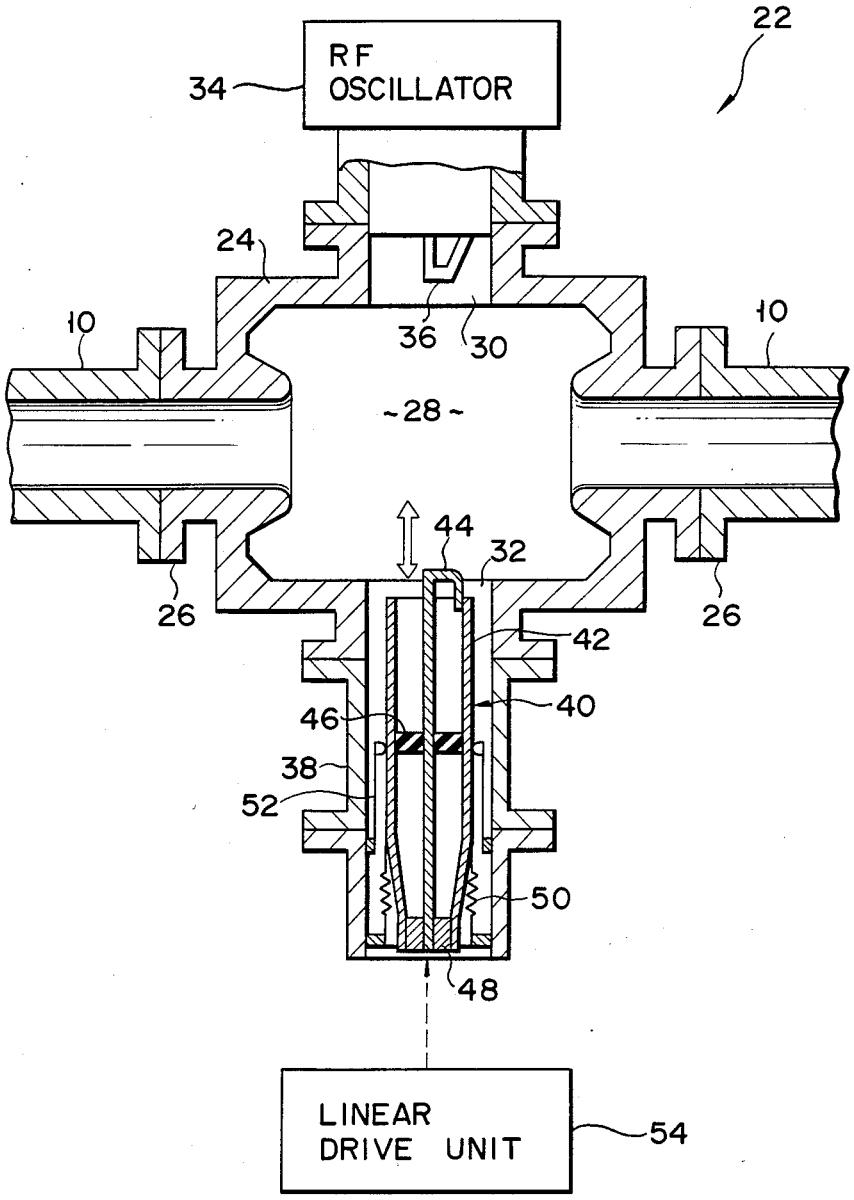
FIG. 2 is a sectional view of part of an accelerator shown in FIG. 1.

The other hole 32 in a lower portion of housing 24 is located at a suitable position in accordance with the parasitic-mode components to be damped, and is airtightly connected to hollow support cylinder 38 through flange coupling. Loop antenna 40 as a damping antenna is arranged in cylinder 38. Loop antenna 40 has outer conductive pipe 42 and inner conductive member 44 arranged inside outer pipe 42. An end of inner member 44 close to accelerating cavity 28, i.e., the upper end of inner member 44 is electrically connected to the upper end of outer pipe 42, as shown in FIG. 2. Seal member 46 comprising an electrically insulating material is arranged at a central portion of outer pipe 42 along the axial direction of pipe 42 in order to airtightly seal the interior of pipe 42. Therefore, inner member 44 airtightly passes through seal member 46. The lower ends of inner member 44 and outer pipe 42 are electrically connected to each other by load resistor 48.

Loop antenna 40 having the above structure and support cylinder 38 are airtightly connected to each other through bellows 50. Antenna 40 can move in the direction indicated by an arrow in FIG. 2 by means of bellows 50. In other words, antenna 40 is supported through bellows 50 to be movable with respect to support cylinder 38 in a direction to project into accelerating cavity 28 or to be removed from cavity 28. Bellows 50 not only supports loop antenna 40 but seals the interior of support cylinder 38 together with seal member 46 described above.

Brush 52 is attached on the inner surface of support cylinder 38 to surround loop antenna 40. The proximal end of brush 52 is electrically connected to cylinder 38, and its distal end is in slidable contact with outer pipe 42 of antenna 40. Brush 52 shields TEM (transverse electromagnetic) waves transmitted from accelerating cavity 28 to a space between antenna 40 and cylinder 38. As a result, bellows 50 can be prevented from being heated by the TEM waves. Note that a bandcut filter for the fundamental-mode is not shown in FIG. 2.

Referring to FIG. 2, the lower end of loop antenna 40 is coupled to linear drive unit 54. Drive units 54 moves loop antenna 40 in the direction indicated by an arrow in FIG. 2 in accordance with the output from RF oscillator 34 described above. The operation of drive unit 54 will be described with reference to FIG. 3.

Figure 3:
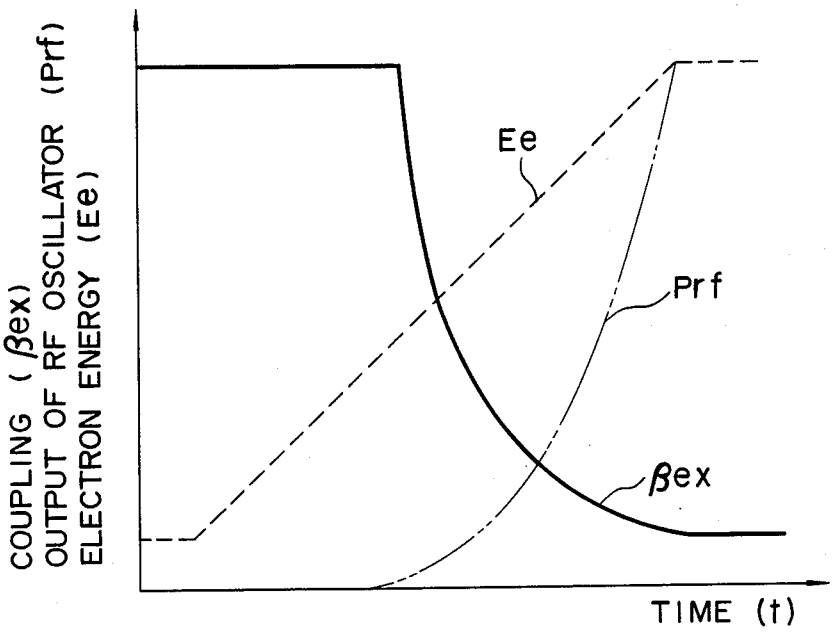
FIG. 3 is a graph for explaining the function of a damping antenna shown in FIG. 2.

When output Prf of RF oscillator 34 is small, i.e., when electron energy Ee of the beam in acceleration tube 10 is small, linear drive unit 54 moves loop antenna 40 upward. Then, the insertion amount of antenna 40 in accelerating cavity 28 is increased. As a result, coupling $\beta$ex of loop antenna 40 with the parasitic mode such as TM110 mode becomes large, as shown in FIG. 3. The parasitic mode is attenuated by antenna 40 and then instability in accelerating the electrons, that results from the coupling of the parasitic mode and electrons that perform betatron oscillation, is suppressed. Therefore, the electron beam can be stably accelerated by the fundamental mode, i.e., TM010 mode. In addition, the other parasitic modes, such as TM011 or TM111 modes, can be attenuated by positioning antenna 40 in an appropriate position. Note that power input to antenna 40 is consumed by load resistor 48.

As shown in FIG. 3, when output Prf of RF oscillator 34 is increased, that is, when electron energy Ee of the beam is increased, linear drive unit 54 operates to decrease the insertion amount of loop antenna 40 with respect to accelerating cavity 28. Then, coupling $\beta$ex of antenna 40 with the parasitic mode is decreased as shown in FIG. 3. When electron energy Ee of the beam is large, coupling $\beta$ex may be small since attenuation of the oscillation of electrons by the beam itself due to so-called radiation damping is large. In contrast to this, with this state since the voltage of oscillator 34, i.e., the acceleration voltage is relatively high, attenuation of the fundamental mode, i.e., TM010 mode is preferably as small as possible. In this respect, when coupling $\beta$ex is decreased, the coupling of antenna 40 and the TM010 is also decreased. Therefore, electrons can be stably accelerated by TM010-mode.

As is apparent from the above description, according to the present invention, the insertion amount of loop antenna 40 with respect to acceleration cavity 28 can be varied, so that electrons of electron energy Ee residing in the range from a low- to high-state can be stably accelerated. The direction of the movement of the antenna 40 doesn't have to be perpendicular to the axis of the cavity 28. The position of holes 32 doesn't have to be at the center of cavity 28 as shown in FIG. 2, hole 32 is set in a proper position according to the feature of the mode to be damped or another physical limit.

Figure 4:
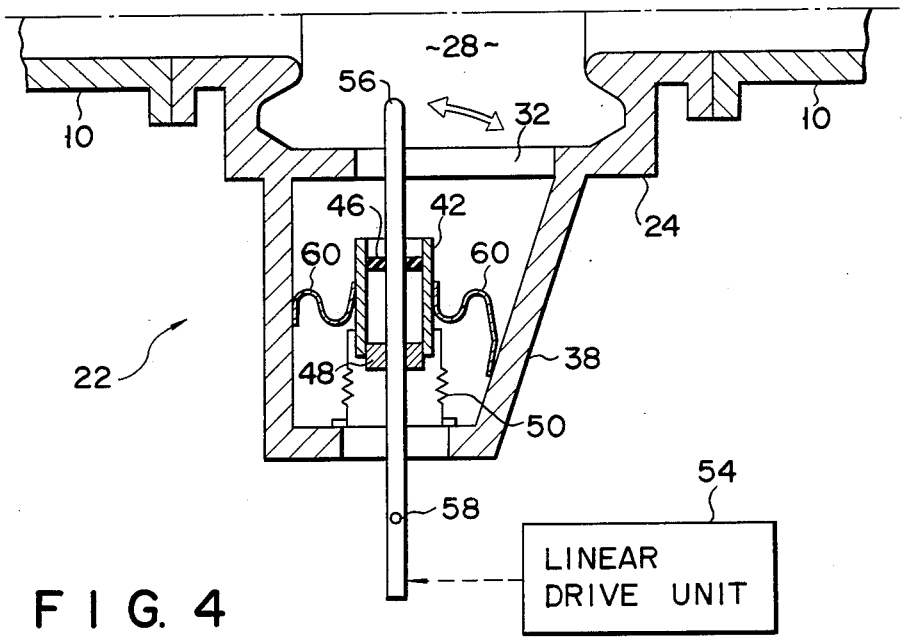
FIG. 4 is a partially sectional view of an accelerator according to another embodiment of the present invention.

The present invention is not limited to the above embodiment. FIG. 4 shows part of a synchrotron-type accelerator according to another embodiment of the present invention. In the accelerator of FIG. 4, the same reference numerals denote the same members having the same functions as those of the accelerator shown in FIG. 2 and a description thereof is omitted.

The accelerator shown in FIG. 4 uses rod antenna 56 in place of loop antenna 40. Antenna 56 airtightly passes through load resistor 48 and seal member 46 arranged in outer pipe 42. The upper end of antenna 56 reaches the interior of accelerating cavity 28. The lower end of antenna 56 projects from the lower end of support cylinder 38 integral with housing 24 of acceleration section 22. The projecting end of antenna 56 is pivotally supported by shaft 58 and its free end is coupled to linear drive unit 54. Therefore, antenna 56 can be rotated about shaft 58 by drive unit 54 in the direction indicated by arrows in FIG. 4. Therefore, also in the embodiment of FIG. 4, the inclination angle of the upper end of antenna 56 with respect to the axis of cavity 28, that is, the insertion amount of antenna 56 with respect to cavity 28 can be varied by rotating antenna 56. The accelerator shown in FIG. 4 thus serves in a similar manner to the accelerator shown in FIG. 2.

In the embodiment shown in FIG. 4, flexible conductive pieces 60 are used in place of brush 52 of FIG. 2.

Finally, in the embodiments described above, linear drive unit 54 is operated from outside the acceleration section in order to manipulate the damping antenna. However, the damping antenna can be manually manipulated without using drive unit 54. Although not described in the above embodiments, cooling means can be provided at elements and portions which are heated, such as the damping antenna and load resistor. In the embodiments described above, the acceleration has one damping antenna. However, the acceleration may have a plurality of damping antennas, if necessary.

What is claimed is:

1. A synchrotron-type accelerator comprising:

orbital means comprising a beam duct defining an orbit of charged particles, that constitutes a closed loop;

an accelerating section inserted in said beam duct and defining an accelerating cavity therein, said accelerating cavity having a predetermined path area in a plane perpendicular to the orbit of the charged particles;

applying means for applying an RF electric field in said accelerating cavity, the RF electric field accelerating the charged particles passing said accelerating cavity so that a fundamental mode is excited in said accelerating cavity;

a rod-shaped damping antenna, pivotally supported on a pivotal support point located outside of the accelerating cavity, one end of said damping antenna extending from the pivotal support point toward the accelerating cavity, and another end thereof extending in a direction away from the accelerating cavity, said one end of the damping antenna being advanced into or retreated from the accelerating cavity through an opening formed in the outer wall of the accelerating cavity when the damping antenna is pivoted on the pivotal support point; and adjusting means for adjusting an angle over which the damping antenna is pivoted, to thereby adjust to what degree said one end of the damping antenna should be inserted into the accelerating cavity, said adjusting means including driving means, connected to said another end of damping antenna, for driving the damping antenna.

2. An accelerator according to claim 1, wherein said adjusting means includes a housing, the interior of which communicates with the accelerating cavity via the opening and which surrounds the one end portion of the damping antenna, with said another end of the damping antenna projected therefrom, and coupling means for airtightly coupling an inner surface of the housing and the damping antenna to each other without adversely affecting the pivotal movement of the damping antenna.

3. An accelerator according to claim 2, wherein said coupling means includes an electrically conductive member through which the damping antenna is airtightly passed, and a bellows which airtightly couples an outer peripheral surface of the electrically conductive member and an inner surface of the housing to each other.

4. An accelerator according to claim 3, wherein said adjusting means further includes shielding means, arranged between said accelerating cavity and said bellows in said housing, for shielding transverse electromagnetic waves transmitted from said accelerating cavity toward said bellows.

5. An accelerator according to claim 4, wherein said housing comprises a conductive material, and said shielding means includes a conductive member having an end coupled to an inner surface of said housing and the other end in slidable contact with said damping antenna.

* * * * *